US011211721B2

(12) United States Patent
Molinero Benitez et al.

(10) Patent No.: US 11,211,721 B2
(45) Date of Patent: Dec. 28, 2021

(54) THREADED STUD WITHIN A CONDUCTIVE BUSHING CONNECTING A PRINTED CIRCUIT BOARD

(71) Applicant: Lear Corporation, Southfield, MI (US)

(72) Inventors: Angel Molinero Benitez, Valls (ES); Ramon Pinana Lopez, Valls (ES); Joan Ignasi Ferran Palau, Valls (ES); Joan Balana Avila, Valls (ES); Josep Maria Pares Caselles, Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/823,846

(22) Filed: Mar. 19, 2020

(65) Prior Publication Data

US 2021/0296796 A1 Sep. 23, 2021

(51) Int. Cl.
*H01R 25/16* (2006.01)
*H01R 4/30* (2006.01)
*H01R 4/70* (2006.01)

(52) U.S. Cl.
CPC ..... *H01R 4/30* (2013.01); *H01R 4/70* (2013.01); *H01R 25/161* (2013.01)

(58) Field of Classification Search
CPC ..... H01R 4/30; H01R 4/70; H01R 4/56–25
See application file for complete search history.

(56) References Cited

U.S. PATENT DOCUMENTS

| | | | | |
|---|---|---|---|---|
| 4,745,530 | A * | 5/1988 | Farrell, Jr. | H01R 33/06 340/472 |
| 6,844,502 | B2 | 1/2005 | Deng et al. | |
| 8,047,868 | B1 * | 11/2011 | Korczynski | H01R 13/5213 439/522 |
| 8,777,642 | B2 * | 7/2014 | Pujol | H01R 4/38 439/97 |
| 9,509,126 | B1 | 11/2016 | Mate | |
| 9,782,851 | B2 * | 10/2017 | Garvey | B23K 9/123 |
| 10,700,451 | B1 | 6/2020 | Pedret et al. | |

FOREIGN PATENT DOCUMENTS

CN 109065824 A 12/2018

* cited by examiner

*Primary Examiner* — Vanessa Girardi
(74) *Attorney, Agent, or Firm* — Brooks Kushman P.C.

(57) ABSTRACT

An electrical connector assembly is provided with a fastener with an elongate body with a threaded portion to receive an electrical terminal, and to receive a threaded fastener to retain the electrical terminal. A conductive body cooperates with the elongate fastener body to engage the electrical terminal and to limit rotation of the fastener relative to the conductive body. A seal is provided between the fastener and the conductive body.

19 Claims, 6 Drawing Sheets

THREADED STUD WITHIN A CONDUCTIVE BUSHING CONNECTING A PRINTED CIRCUIT BOARD

TECHNICAL FIELD

Various embodiments relate to electrical connector assemblies.

BACKGROUND

An electrical connector assembly is disclosed in Pujol et al., U.S. Pat. No. 8,777,642 B2, which issued on Jul. 15, 2014 to Lear Corporation.

SUMMARY

According to at least one embodiment, an electrical connector assembly is provided with a fastener with an elongate body with a threaded portion to receive an electrical terminal, and to receive a threaded fastener to retain the electrical terminal. A conductive body cooperates with the elongate fastener body to engage the electrical terminal and to limit rotation of the fastener relative to the conductive body.

According to a further embodiment, a seal is provided between the fastener and the conductive body.

According to another further embodiment, the conductive body has an aperture formed therein, with the elongate fastener body received within the aperture.

According to an even further embodiment, the elongate fastener body is externally splined and in engagement with the conductive body aperture to limit rotation of the elongate fastener body relative to the conductive body.

According to an even further embodiment, the elongate fastener body is externally threaded and in threaded engagement with the conductive body aperture to limit movement of the elongate fastener body relative to the conductive body.

According to another further embodiment, a groove is formed about the elongate fastener body. A seal is oriented within the groove to engage the conductive body aperture and to seal the conductive body aperture.

According to an even further embodiment, the groove is annular, and the seal is a ring.

According to another even further embodiment, the conductive body aperture or the elongate fastener body is sized to limit rotation of the fastener relative to the conductive body.

According to another further embodiment, the conductive body is formed from a material with greater conductivity than a material of the fastener.

According to another further embodiment, the threaded portion of the fastener is externally threaded.

According to an even further embodiment, the threaded portion is at one end of the fastener, and the fastener has a second threaded portion at another end of the fastener.

According to another even further embodiment, the conductive body extends through a printed circuit board and a filter. The fastener extends through the conductive body and a busbar.

According to at least another embodiment, an electrical assembly is provided with a housing with an opening formed therein. A busbar is oriented within the housing. A filter is oriented about the housing opening. A printed circuit board (PCB) is oriented within the housing. An electrical connector assembly is mounted to the housing with a fastener with an elongate body with a threaded portion to receive an electrical terminal, and to receive a threaded fastener to retain the electrical terminal. A conductive body cooperates with the elongate fastener body to engage the electrical terminal. A seal is provided between the fastener and the conductive body. The threaded portion of the fastener is externally threaded. The threaded portion is at one end of the fastener. The fastener has a second threaded portion at another end of the fastener. The conductive body extends through a printed circuit board and a filter. The fastener extends through the conductive body and a busbar. The conductive body extends through the filter and the PCB. The second threaded end of the fastener extends through the busbar. An electrical terminal is mounted about the first threaded end of the fastener external of the housing and in electrical contact with the conductive body. A first internally threaded fastener is fastened to the first threaded end of the fastener to retain the electrical terminal in electrical communication with the conductive body. A second internally threaded fastener is fastened to the second threaded end of the fastener to retain the busbar in electrical communication with the conductive body.

According to at least another embodiment, an electrical connector assembly is provided with a fastener with an elongate body with a threaded portion to receive an electrical terminal, and to receive a threaded fastener to retain the electrical terminal. A conductive body cooperates with the elongate fastener body to engage the electrical terminal. An insulative housing partially encloses and seals the fastener or the conductive body.

According to a further embodiment, the insulative housing is molded over the fastener or the conductive body.

According to another further embodiment, a seal is oriented between the conductive body and the insulative housing to seal the conductive body. A groove is formed about the conductive body and the seal is oriented within the groove to engage the insulative housing.

According to another even further embodiment, an electrical terminal is oriented partially within the insulative housing in electrical contact with the conductive body and extending through the housing for an external electrical connection.

According to another even further embodiment, the electrical terminal is welded to the conductive body or wherein the electrical terminal is formed integrally with the conductive body.

According to another further embodiment, the insulative housing is further provided with a pin to extend through a printed circuit board (PCB) to align the conductive body and the fastener relative to the PCB.

According to at least another embodiment, an electrical connector assembly is provided with a fastener with an elongate body with a splined portion and an externally threaded distal end to receive an electrical terminal and to receive a threaded fastener to retain the electrical terminal, and an annular groove formed about the elongate fastener body. A conductive body is formed from a material with greater conductivity than a material of the fastener with a through aperture to receive the externally splined elongate fastener body with an interference fit to limit rotation of the elongate fastener body. The conductive body has a contact surface to engage the electrical terminal. A seal ring is oriented within the annular groove in the elongate fastener body to engage the conductive body through aperture and to seal the conductive body through aperture. An insulative housing partially encloses and seals the fastener or the conductive body. An electrical terminal extends through the insulative housing spaced apart from the externally threaded distal end of the fastener in electrical communication with the conductive body.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In various electrical applications, electrical currents are utilized to drive ranges over hundreds of Amperes. Such applications are common in automotive applications, due to the advancements in electric vehicles and hybrid-electric vehicles. The high ampere applications often employ threaded fastener connections with minimized resistance to reduce conduction loses (and heating). In certain layouts, available space is limited because of the number of surrounding components (and connection length).

High current applications often utilize electrical connectors that are customized for a dedicated application. The connectors are often formed from hard materials to withstand torque forces, which consequently result in a significant voltage drop and a heat increase for high currents.

Figure 1:
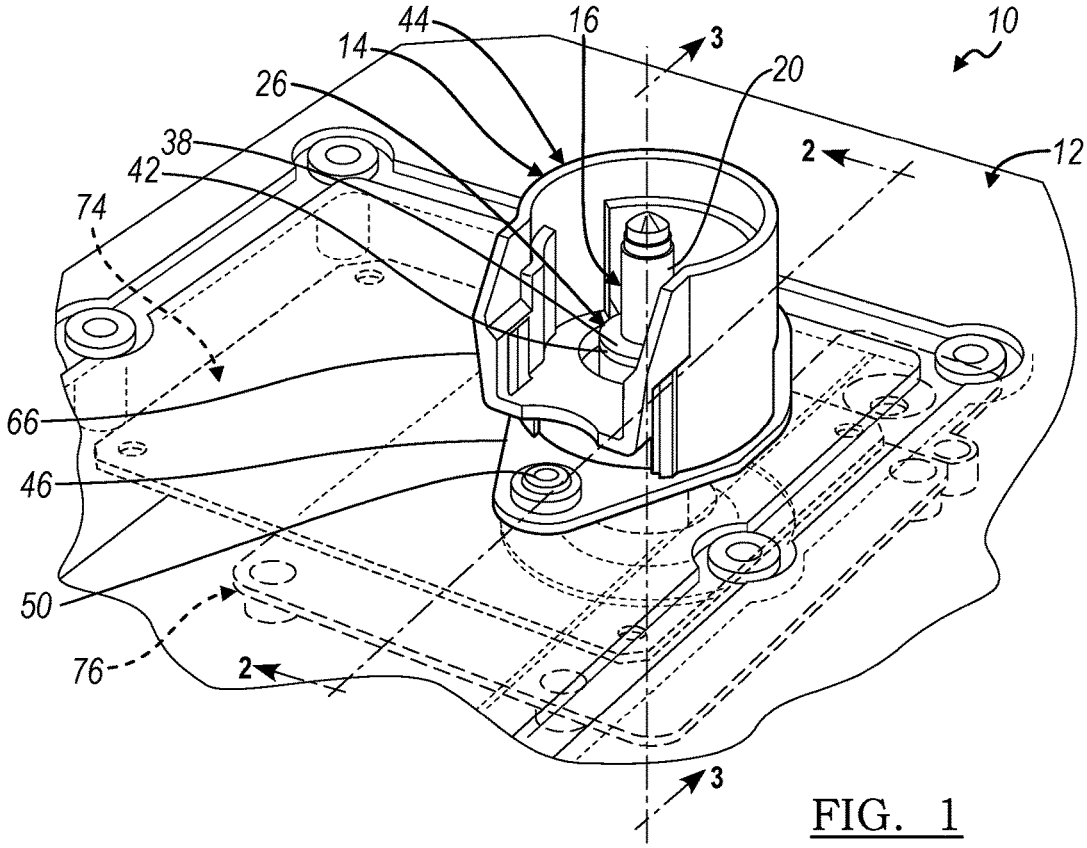
FIG. 1 is a partial perspective view of an electrical assembly according to an embodiment.

FIG. 1 illustrates an electrical assembly 10 according to an embodiment. The electrical assembly 10 includes a housing 12 for enclosing and retaining electronics. An electrical connector assembly 14 is provided on the housing 12 to provide an electrical connection with internal electrical components within the housing 12. The electrical assembly 10 may be an automotive electrical assembly 10, such as an on-board vehicle charger, converter, inverter, batteries, telecommunications, or any electrical assembly 10 with an electrical connector assembly 14 with a fastener input or output for communication of high currents.

Referring now to FIGS. 1-4, the electrical connector assembly 14 includes a dual fastener, such as a dual threaded stud 16 for high current connections, while keeping a minimal cross section. The stud 16 is formed from a structural metal, such as steel. The stud 16 has an elongate body 18 with an externally threaded distal end region 20. Now with reference to FIGS. 2-4, the stud 16 has an intermediate region 22 with a reduced diameter relative to the threaded distal end region 20. The intermediate region 22 is externally splined or knurled. The stud 16 also includes an externally threaded proximal end region 24. The threaded proximal end region 24 may have a reduced diameter relative to the intermediate region 22 as depicted.

Figure 2:
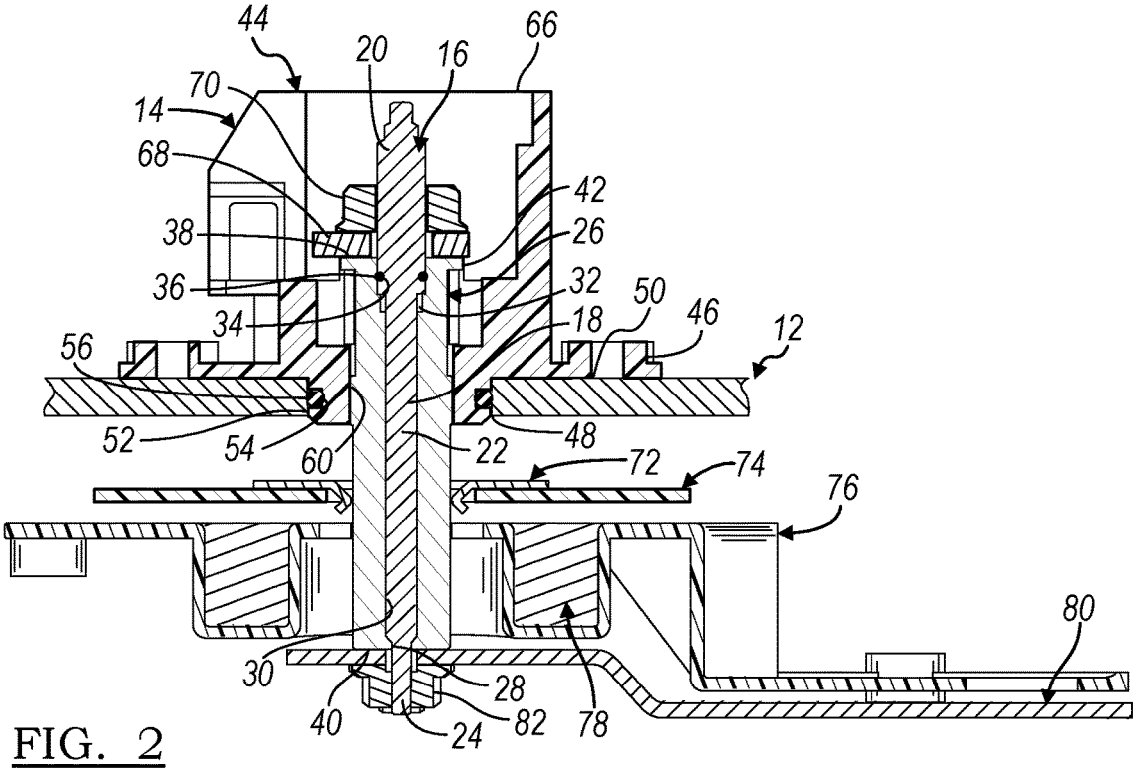
FIG. 2 is a side section view of an electrical connector assembly of the electrical assembly of FIG. 1, taken along section line 2-2.
Figure 3:
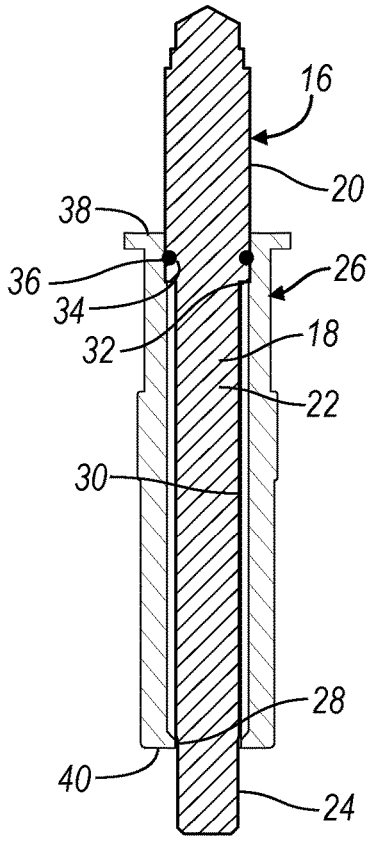
FIG. 3 is a partial side section view of the electrical connector assembly of FIG. 2, taken along section line 3-3 in FIG. 1.

The electrical connector assembly 14 includes a conductive body, which in the depicted embodiment, is an external bushing 26 and is illustrated in FIGS. 1-4. The bushing 26 is formed from a material with a higher conductivity in comparison to steel, such as a copper-alloy. As depicted in FIGS. 2 and 3, the bushing 26 includes a proximal through aperture 28 to permit the threaded proximal end region 24 of the stud 16 to extend out of the bushing 26.

The bushing 26 also includes an internal bore 30, which is sized to receive the externally splined intermediate region 22 of the stud 16 by an interference fit. The stud 16 is pressed into the bushing 26 so that the splined region 22 of the stud 16 is forced into engagement with the bore 30 to limit rotation of the stud 16 relative to the bushing 26. Since the stud 16 is formed from a steel material with greater strength than the bushing 26, the stud 16 is splined or knurled to consequently deform and mate with the bushing 26 to provide a rotation resistant connection of the bushing 26 to the stud 16.

Figure 4:
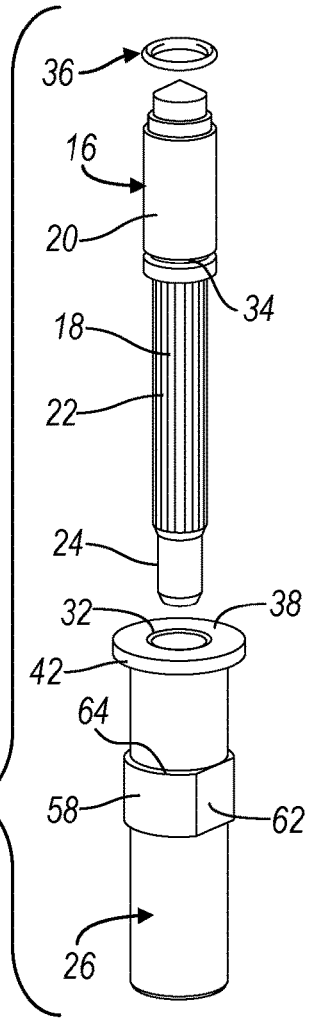
FIG. 4 is an exploded perspective view of the partial electrical connector assembly of FIG. 3.

Continued reference is made to FIGS. 2-4, whereby the bushing 26 includes an enlarged bore 32 formed in the distal end to a blind depth terminating at the splined bore 30 to receive a portion of the distal end region 20 of the stud 16. An annular groove 34 is formed in the distal end region 20 of the stud 16 to receive a seal, such as an elastomeric O-ring 36. The seal ring 36 engages the enlarged bore 32 to provide a sealed connection at the distal end regions 20, 32 of the stud 16 and the bushing 26.

The bushing 26 includes a flat contact surface 38 at the distal end, and another flat contact surface 40 at the proximal end. The contact surfaces 38, 40 are for electrical contact with an electrical terminal attached to the stud 16. The bushing 26 includes a flange 42 at the distal end to enlarge the distal contact surface 38. The bushing 26 has greater conductivity than the stud 16, and therefore improves energy flow through the electrical connector assembly 14.

With reference to FIGS. 1 and 2, the stud 16 and the bushing 26 are installed into a header 44 for installation upon the housing 12. The header 44 acts as a partial housing for the electrical connector assembly 14 to enclose and seal the connector assembly 14. The header 44 may be formed from plastic and may be over-molded over the bushing 26 to provide a sealed connection between the header 44 and the bushing 26. The header 44 is formed from an insulative plastic to insulate the bushing 26 and the stud 16 from inadvertent electrical communication with other components.

The bushing 26 may also be externally splined according to an embodiment. The header 44 is plastic, and is over-molded onto the bushing 26 to form into the spline for engagement with the bushing 26 and to prevent rotation of the bushing 26 relative to the header 44. Alternatively, since the metal bushing 26 is formed of a material that is stronger than the plastic header 44, the bushing 26 may be pressed into header 44 for an interference fit. The external spline or knurl of the bushing 26 may deform the plastic header 44 to form grooves or deformations in the header 44 to provide the anti-rotation feature.

The header 44 includes a flange 46 to attach to the housing 12 and cover an opening 48 (FIG. 2) formed into the housing 12. The flange 46 includes a mounting pattern 50 for fastening the flange 46 and the electrical connector assembly 14 to the housing 12. The header 44 also includes a boss 52 extending from the flange 46. The boss 52 is sized to be received in the opening 48 of the housing 12. An annular groove 54 is formed about the boss 52. An annular seal ring or gasket 56 is oriented in the groove 54 to engage the housing opening 48 to seal the connection between the header 44 and the housing 12.

The bushing 26 and the stud 16 pass through the header 44 and through the boss 52 to extend through the header 44 and through the housing opening 48 to provide an electrical connection external of the housing 12 and internal of the housing 12 to pass current through the housing 12. With reference to FIG. 4, and according to an embodiment, the bushing 26 includes an enlarged intermediate portion 58 to resist rotation and axial displacement of the bushing 26 within the header 44. The intermediate portion 58 is embedded within a receptacle 60 formed in the header 44 by over-molding the header 44, to accommodate the bushing 26 with the intermediate portion 58, as illustrated in FIG. 2. Referring again to FIG. 4, the intermediate portion 58 includes a pair of lateral flats 62 to resist rotation of the bushing 26 relative to the header 44. The enlarged intermediate portion 58 also includes a pair of axial flats 64 to resist axial displacement of the bushing 26 relative to the header 44. By over-molding the header 44 over the intermediate portion 58 of the bushing 26, the intermediate portion 58 is embedded within the header 44 for supportive contact with the lateral flats 62 and the axial flats 64. Alternatively, the bushing 26 can be externally splined or knurled to limit rotation of the bushing 26 relative to the header 44.

Referring to FIGS. 1 and 2, the header 44 includes an external receptacle 66 for partially shrouding the stud distal end region 20 and the bushing distal end contact surface 38. Referring now to FIG. 2, a conductive terminal 68 is placed about the stud distal end region 20 and upon the bushing distal end contact surface 38 for electrical contact of the terminal 68 and the bushing 26. An internally threaded fastener, such as a nut 70 is fastened upon the threaded stud distal end region 20 to fasten and retain the terminal 68 upon the bushing distal end contact surface 38. The receptacle 66 may be sized for receipt of a cover to avoid contaminants within the receptacle 66 or undesired external contact, such as tools, wires, operators, or the like.

The bushing 26 and the stud 16 pass through an interconnection ring 72 in a printed circuit board (PCB) 74. The bushing 26 is in electrical contact with the interconnection ring 72 to deliver electrical current to the interconnection ring 72, and consequently, the PCB 74. A substrate 76 is oriented within the housing 12 to support a filter 78 and a busbar 80. The substrate 76 may be formed from plastic or any suitable lightweight and structurally supportive material. The substrate 76 supports the filter 78 about the bushing 26. The filter 78 is a magnetic core filter to isolate noise or interference from the high currents distributed through the bushing 26.

The substrate also supports the conductive busbar 80, which acts as a terminal in electrical communication with the bushing 26. The busbar 80 is received about the proximal threaded end 24 of the stud 16 to engage the proximal end contact surface 40 of the bushing 26 for electrical contact with the bushing 26. A second internally threaded fastener or nut 82 is provided on the threaded proximal end 24 of the stud to fasten and retain the busbar 80 in electrical contact with the proximal end contact surface 40 of the bushing 26.

The electrical connector assembly 14 provides a high conductive connection, with a slim, minimal section compactness with threaded fasteners 16, 70, 82 for retaining terminals 68, 80. Where a narrow space is available, with a deep electrical connection path, the high-current slim connection is achieved by the electrical connector assembly 14 by integrating the threaded steel stud 16 with the copper-alloy bushing 26. The bushing 26 provides a minimum-resistance connection (minimizing current losses and heat increases), while the stud 16 provides a robust mechanical connection. The stud 16 and bushing 26 subassembly is inserted in the plastic mold of the connector header 44, which may be a separate component, or integrally formed with the housing 12. Sealing gaskets or rings 36, 56 resist contaminants from penetrating the housing 12. The elongate shape of the bushing 26 and the stud 16 enables for several components in between the threaded stud ends 20, 24, for example, the electronic PCB 74 with the electromagnetic current (EMC) filter 78. Anti-rotation features 22, 30 are provided between metal to metal interfaces. Anti-rotation features 62 are also provided between metal to plastic interfaces.

Figure 5:
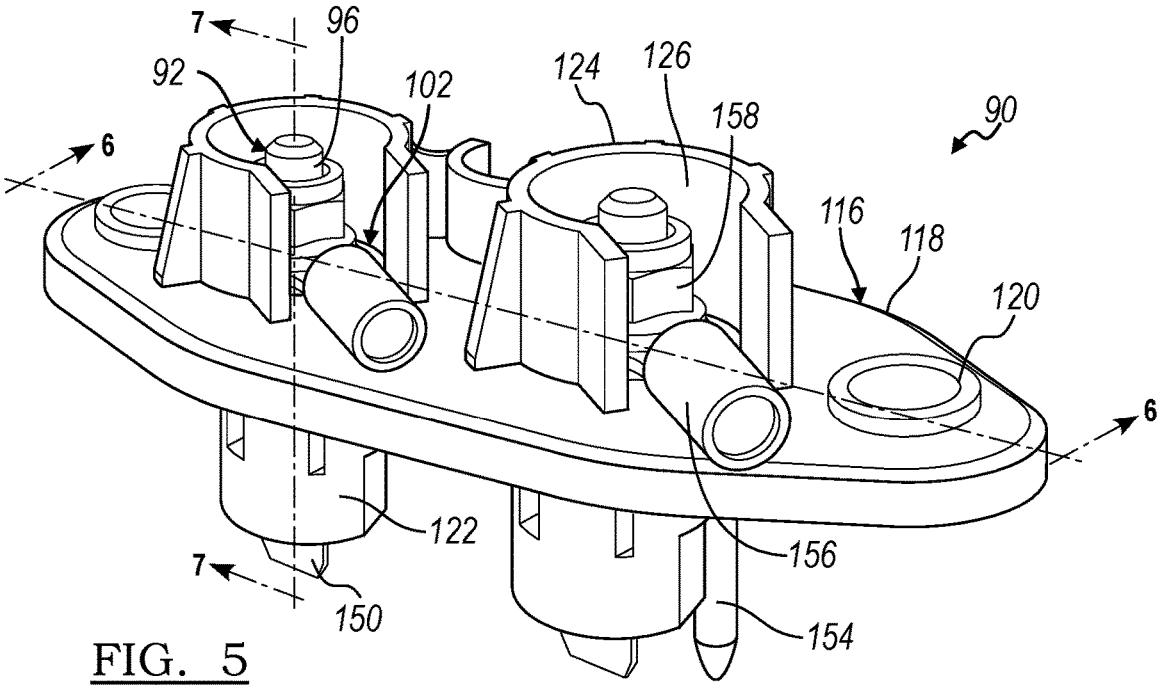
FIG. 5 is a perspective view of an electrical connector assembly according to another embodiment.
Figure 6:
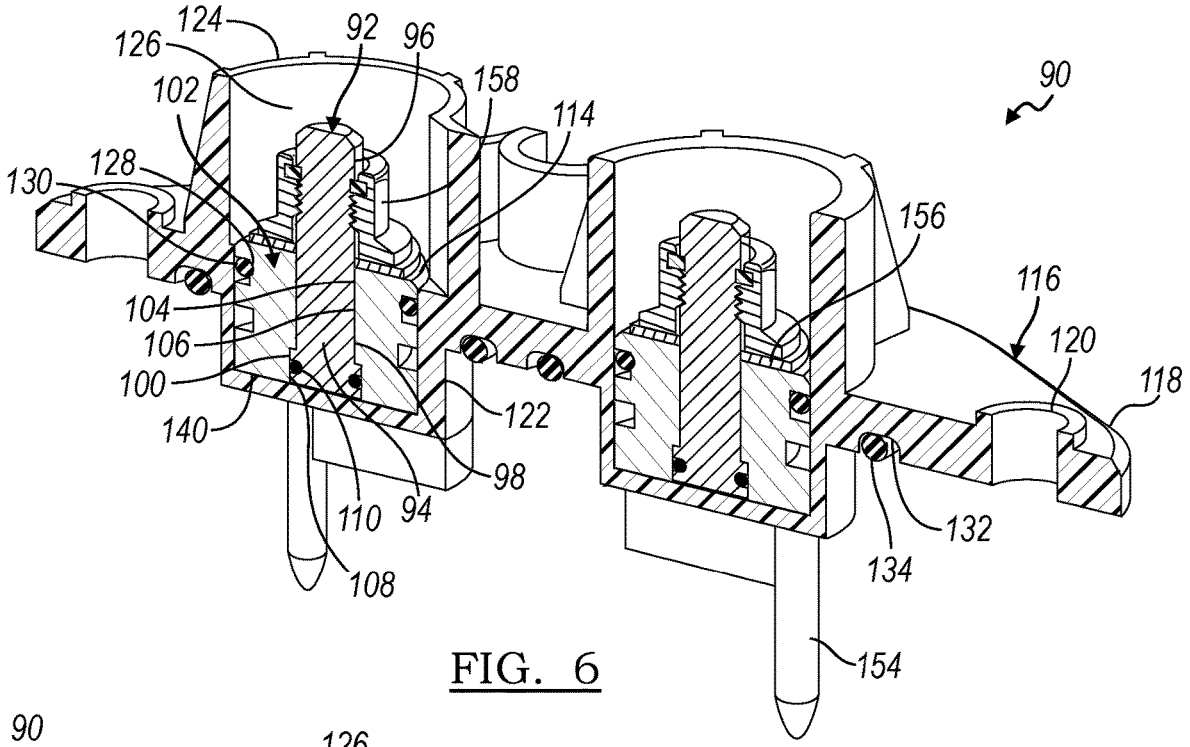
FIG. 6 is a side section view of the electrical connector assembly of FIG. 5, taken along line 6-6.
Figure 7:
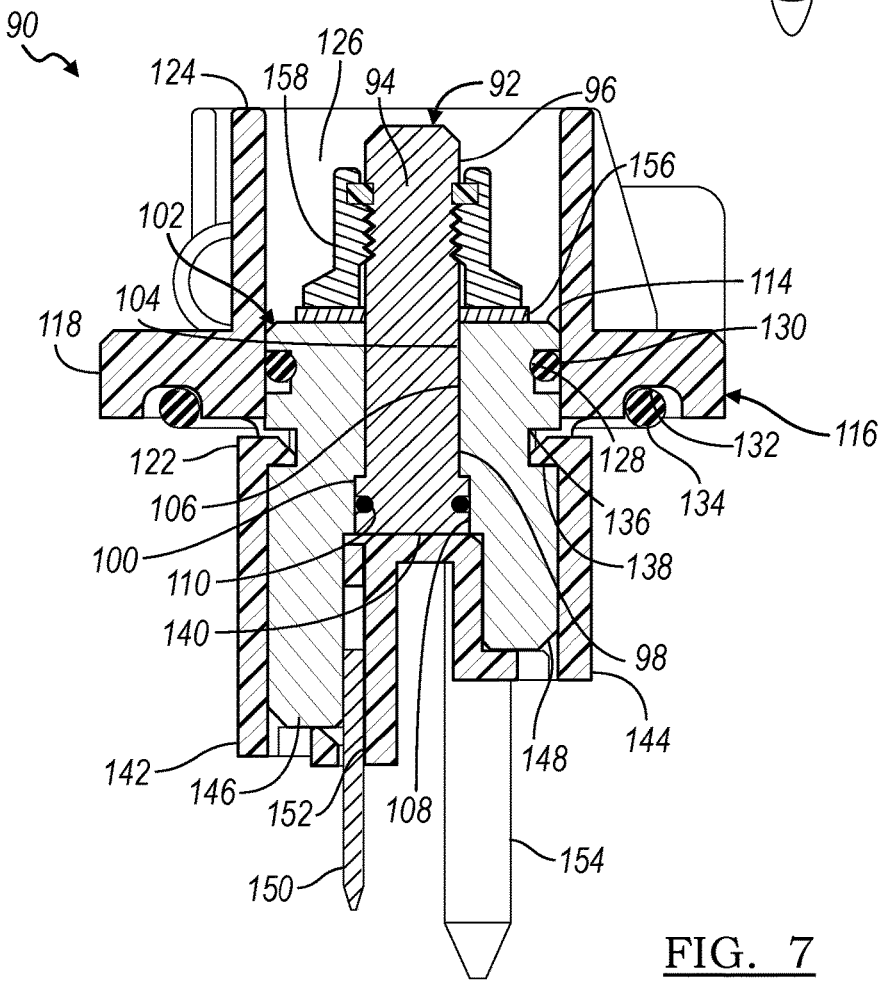
FIG. 7 is another side section view of the electrical connector assembly of FIG. 5, taken along line 7-7.
Figure 8:
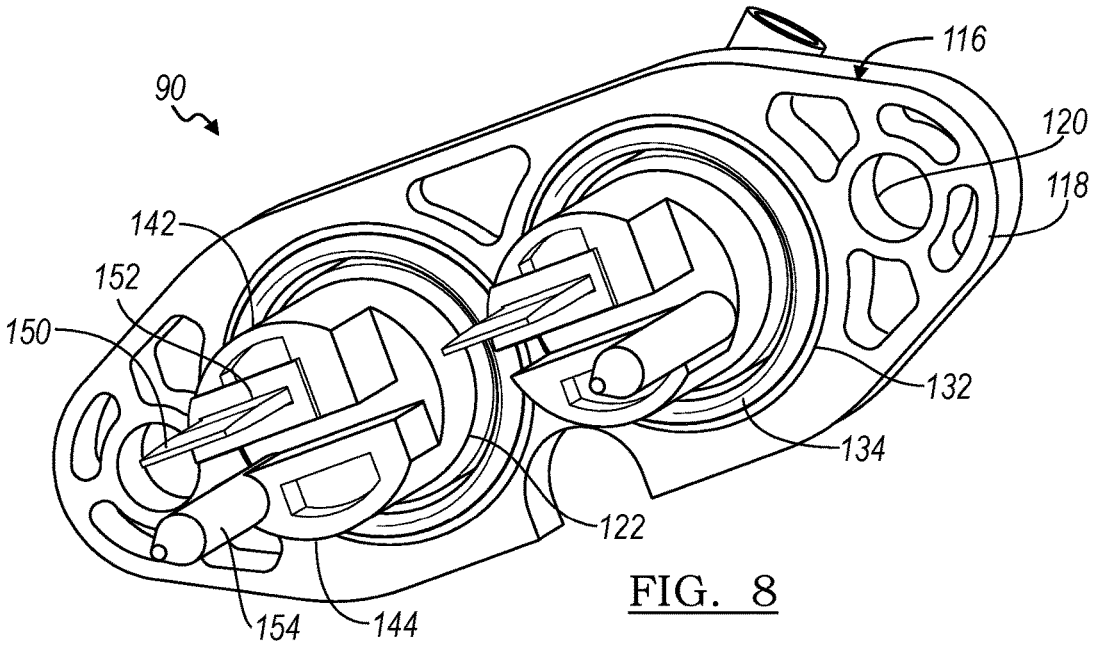
FIG. 8 is bottom perspective view of the electrical connector assembly of FIG. 5.
Figure 9:
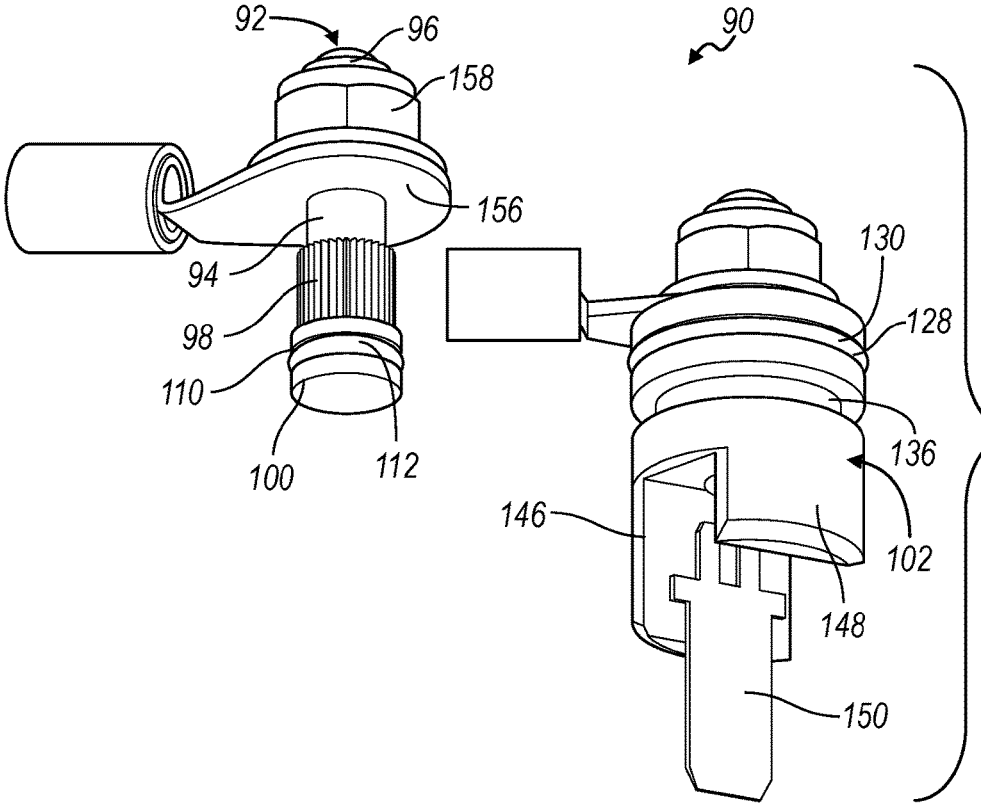
FIG. 9 is a partial exploded perspective view of the electrical connector assembly of FIG. 5.

FIGS. 5-9 illustrate an electrical connector assembly 90 according to another embodiment. The electrical connector assembly 90 is provided on a housing to provide an electrical connection with internal and external electrical components of the housing. The electrical connector assembly 90 includes a pair of fasteners, such as threaded studs 92 for high current connections. Each stud 92 has an elongate body 94 with an externally threaded distal end region 96. With reference to FIGS. 6, 7 and 9, each stud 92 has an externally splined intermediate region 98. The stud 92 also includes an enlarged proximal end region 100 with a diameter greater than that of the intermediate region 98 and the distal end region 96.

The electrical connector assembly 90 includes a pair of conductive copper-alloy external bushings 102 as illustrated in FIGS. 6, 7 and 9. Referring to FIGS. 6 and 7, each bushing 102 includes a distal through aperture 104 to permit the threaded distal end region 96 of the stud 92 to extend out of the bushing 102. The bushing 102 also includes an internal intermediate bore 106, which is sized to receive the externally splined intermediate region 98 of the stud 92. The stud 92 is pressed into the bushing 102 so that the splined region 98 of the stud 92 is formed into engagement within the bore 106 by deformation of the bushing 102 to limit rotation of the stud 92 relative to the bushing 102.

The bushing 102 includes an enlarged bore 108 formed in the proximal end to a blind depth terminating at the splined bore 106 to receive the enlarged proximal end region 100 of the stud 92. Referring now to FIGS. 6, 7 and 9, an annular groove 110 is formed in the enlarged proximal end region 100 of the stud 92 to receive a seal, such as an elastomeric O-ring 112. With reference now to FIGS. 6 and 7, the seal ring 112 engages the enlarged bore 108 to provide a sealed connection at the proximal end regions 100, 108 of the stud 92 and the bushing 102. Each bushing 102 includes a flat contact surface 114 at the distal end. The contact surface 114 is for electrical contact with an electrical terminal attached to the stud 92. The bushing 102 has greater conductivity than the stud 92, and therefore improves energy flow through the electrical connector assembly 90.

With reference to FIGS. 5-8, the studs 92 and the bushings 102 are installed into a header 116 for installation upon the housing. The header 116 acts as a partial housing for the electrical connector assembly 90 to enclose and seal the connector assembly 90. The header 116 may be formed from an insulative plastic to insulate the bushings 102 and the studs 92 from inadvertent electrical communication with other components.

The header 116 includes a flange 118 to attach to the housing 12 and cover an opening formed into the housing. The flange 118 includes a mounting pattern 120 for fastening the flange 118 and the electrical connector assembly 90 to the housing. The header 116 includes a pair of sockets 122 extending beneath the flange 118 to extend into the housing. Referring now to FIGS. 5-7, a pair of receptacles 124 extend above the flange 118. Each socket 122 and receptacle 124 combination is formed with a cavity 126 to receive one of the bushings 102 within the cavity 126.

With reference to FIGS. 6, 7 and 9, an annular groove 128 is formed about each bushing 102. A gasket or ring seal 130 is provided in the bushing annular groove 128 to engage an inner wall of the cavity 126 to seal the connection of the bushing 102 with the header 116. A plurality of grooves 132 are formed underneath the flange 118. A plurality of gaskets or seal rings 134 are provided in each groove 132 to engage the housing and seal a connection of the header 116 upon the housing.

The studs 92 are inserted into the bushings 102; and then the bushings 102 are inserted into the header cavities 126. According to an embodiment, the studs 92 are externally splined, and therefore are pressed into the bushings. Consequently, each bushing 102 engages the enlarged proximal end region 100 of the stud 92 to retain the stud 92 axially within the header 116. Then, the stud 92 and bushing 102 assemblies are manually installed into the header cavities 126.

With reference to FIGS. 7 and 9, each bushing 102 includes an additional annular groove 136 formed circumferentially about the bushing 102. Referring again to FIG. 7, each socket 122 of the header 116 includes a plurality of retainers 138 with a leading edge to expand as the bushing 102 is inserted into the cavity 126, and an abutment edge to retract and enter the groove 136 to engage the groove 136 and retain the bushing 102 axially within the header 116.

With reference to FIGS. 6 and 7, the cavity 126 extends to a blind depth 140 to limit insertion of the bushing 102 and the stud 92. Referring now to FIGS. 7 and 8, the socket 122 also includes a plurality of smaller lateral asymmetrical sockets 142, 144 extending below the blind depth 140 of the cavity 126. As illustrated in FIGS. 7 and 9, each bushing 102 includes a pair of asymmetrical extensions 146, 148. The asymmetry of the sockets 142, 144 and the bushing extensions 146, 148 prevent inadvertent assembly of the electrical connector assembly 90. Referring to FIGS. 7 and 8, the receipt of the lateral bushing extensions 146, 148 in the sockets 142, 144 limits rotation of the bushings 102 relative to the header 116.

Referring to FIGS. 5, and 7-9 an electrical terminal blade 150 is welded to one of the lateral bushing extensions 146 and extends through an aperture 152 (FIG. 8) in the header 116. The electrical terminal blades 150 extend through the header 116 into the housing to provide electrical contact with an internal electrical component, such as a PCB. The header 116 includes a pair of alignment pins 154 (FIGS. 5-8) for alignment of the header 116 and the terminal blades 150 with the housing and the associated internal electrical components, such as the PCB.

Referring to FIGS. 5-7, the receptacle 124 of the header 116 partially shrouds the stud distal end region 96 and the bushing distal end contact surface 114. As illustrated in FIGS. 5-7 and 9, a conductive terminal 156 is placed about each stud distal end region 96 and upon the bushing distal end contact surface 114 for electrical contact of the terminal 156 and the bushing 102. An internally threaded fastener, such as a nut 158 is fastened upon the threaded stud distal end region 96 to fasten and retain the terminal 156 upon the bushing distal end contact surface 114.

The electrical connector assembly 90 permits blind insertion of terminal blades 150 into a housing and the enclosed electrical components. The copper-alloy bushings 102 permit efficient current flow, while the studs 92 provide robust fixation of the terminals 156. The electrical connector assembly 90 provides seals 112, 130, 134 for a water-tight connection of the electrical connector assembly 90 to the housing. The stud 92, the bushing 102 and the terminal blade 150 provide compactness to the electrical connector assembly 90, which can extend a sufficient length to cooperate with the associated housed electrical components.

Figure 10:
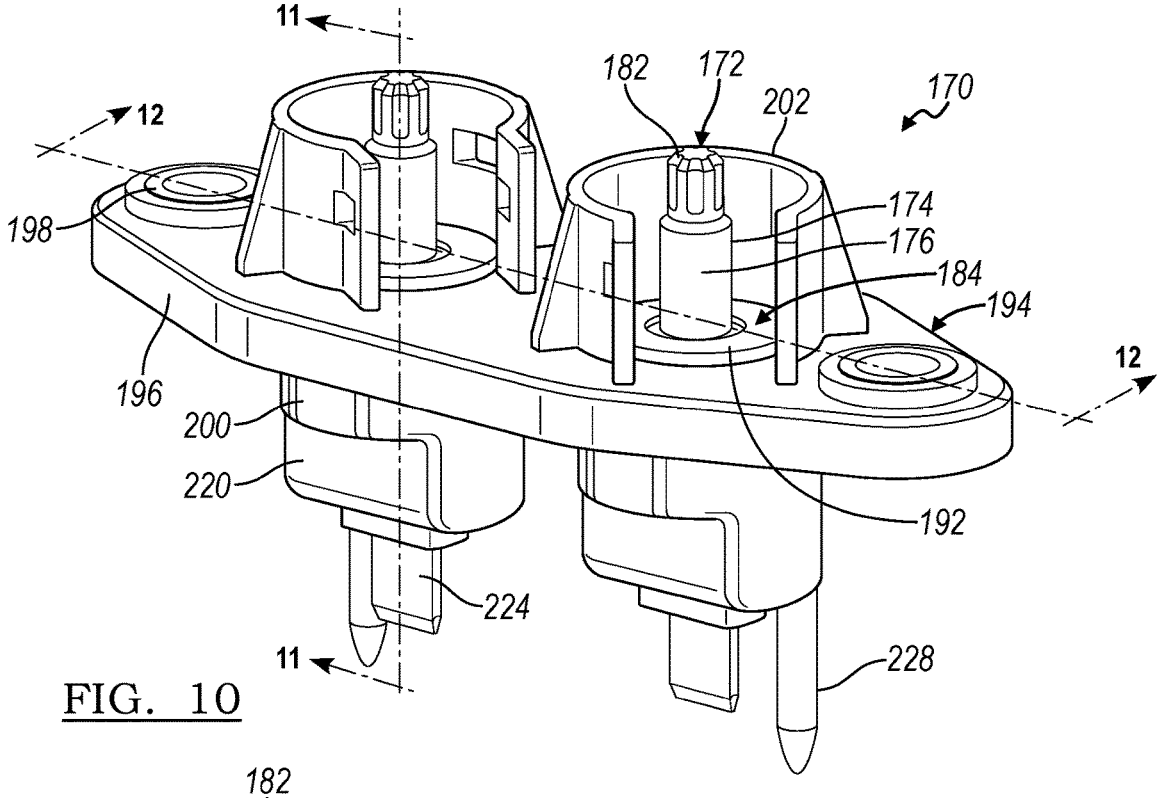
FIG. 10 is a perspective view of an electrical connector assembly according to another embodiment.
Figure 11:
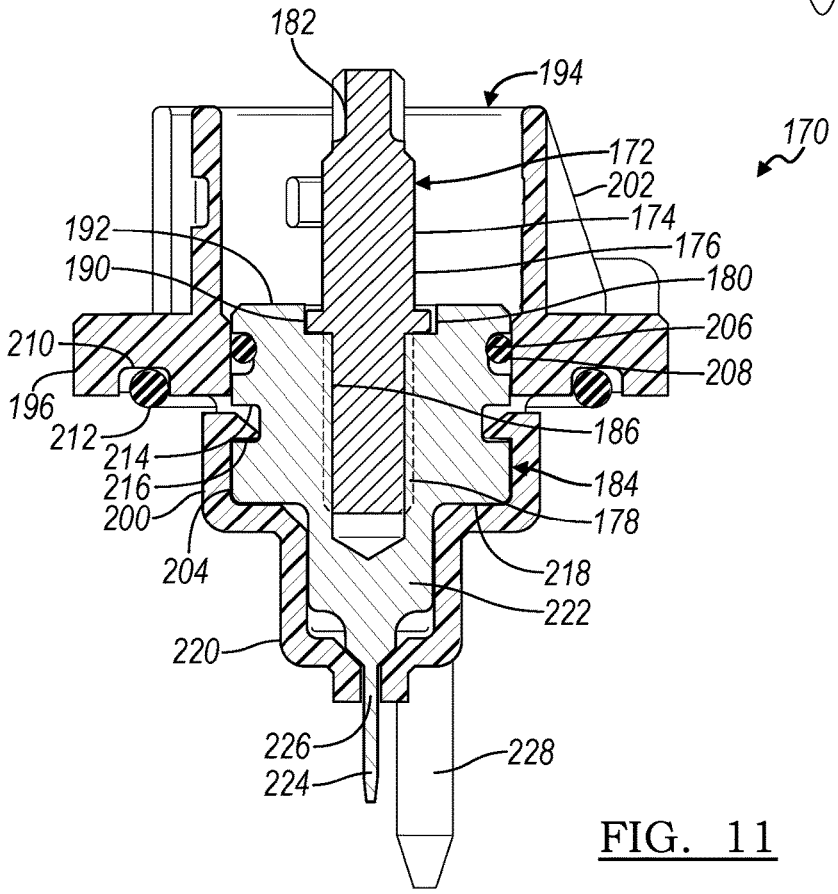
FIG. 11 is a side section view of the electrical connector assembly of FIG. 10, taken along line 11-11.
Figure 12:
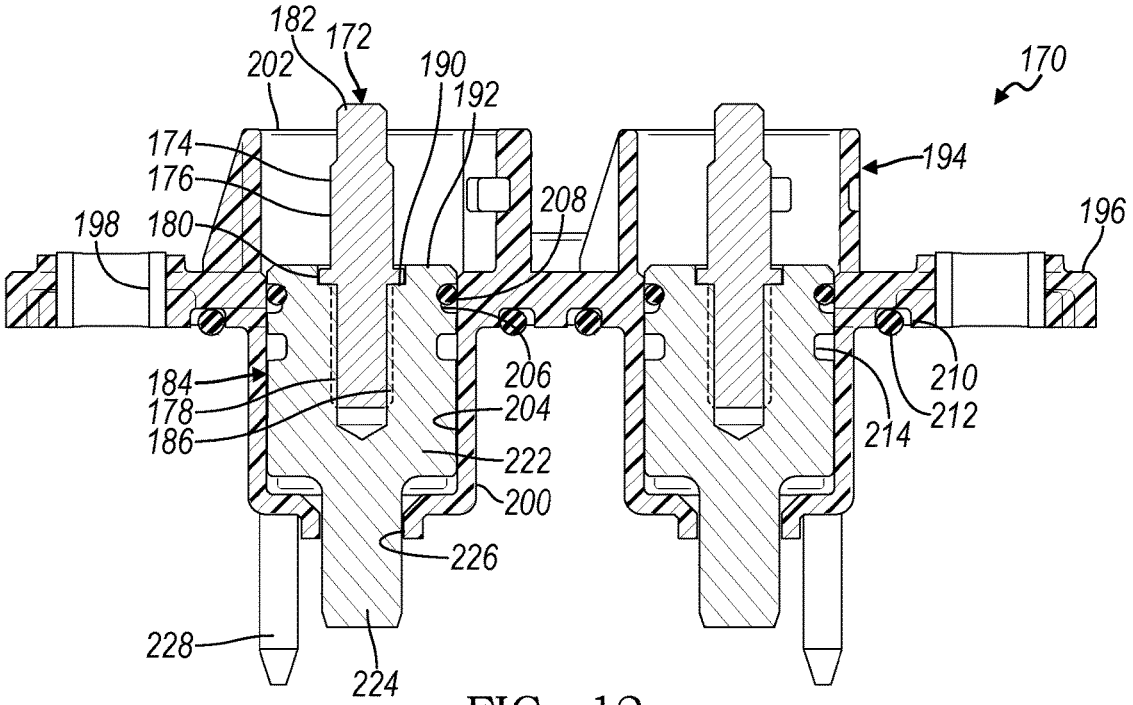
FIG. 12 is another side section view of the electrical connector assembly of FIG. 10, taken along line 12-12.
Figure 13:
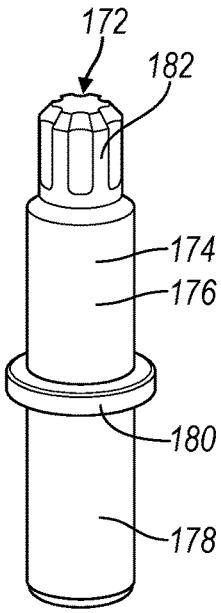
FIG. 13 is a side perspective view of a fastener of the electrical connector assembly of FIG. 10.

FIGS. 10-12 illustrate an electrical connector assembly 170 according to another embodiment. The electrical connector assembly 170 is provided on a housing to provide an electrical connection with internal and external electrical components of the housing. The electrical connector assembly 170 includes a pair of fasteners, such as threaded studs 172 for high current connections. One of the threaded studs 172 is also illustrated in FIG. 13. Each stud 172 has an elongate body 174 with an externally threaded distal end region 176. Referring now to FIGS. 11-13, each stud 172 has an externally threaded proximal end region 178. The stud 172 also includes an enlarged intermediate region 180 with a diameter greater than that of the proximal end region 178 and the distal end region 176. A socket head 182 is provided at the distal end region 176 so that the studs 172 can be rotary driven by a corresponding rotary tool.

The electrical connector assembly 170 includes a pair of conductive copper-alloy external bushings 184 as illustrated in FIGS. 10-12 and 14. Referring to FIGS. 11 and 12, each bushing 184 includes an internally threaded blind depth aperture 186 sized to receive the threaded proximal end region 178 of the stud 172 with the threaded distal end region 176 of the stud 172 extending away from the bushing 184. The socket head 182 can be driven by a tool to fasten the stud 172 to the bushing 184. The bushing 184 includes an enlarged bore 190 formed in the proximal end to a blind depth terminating at the blind depth aperture 186 to receive the enlarged intermediate region 180 of the stud 172 to provide a limit of translation of the stud 172 into the aperture 186 of the bushing 184. Since the aperture 186 is formed to a blind depth, no additional seal is provided between the stud 172 and the bushing 184.

Referring again to FIGS. 10-12 and 14, each bushing 184 includes a flat contact surface 192 at the distal end. The contact surface 192 is for electrical contact with an electrical terminal attached to the stud 172. The bushing 184 has greater conductivity than the stud 172, and therefore improves energy flow through the electrical connector assembly 170.

With reference to FIGS. 10-12, the studs 172 and the bushings 184 are installed into a header 194 for installation upon the housing. The header 194 acts as a partial housing for the electrical connector assembly 170 to enclose and seal the connector assembly 170. The header 194 may be formed from an insulative plastic to insulate the bushings 184 and the studs 172 from inadvertent electrical communication with other components.

The header 194 includes a flange 196 to attach to the housing and cover an opening formed into the housing. The flange 196 includes a mounting pattern 198 for fastening the flange 196 and the electrical connector assembly 170 to the housing. The header 194 includes a pair of sockets 200 extending beneath the flange 196 to extend into the housing. A pair of receptacles 202 extend above the flange 196. Each socket 200 and receptacle 202 combination is formed with a cavity 204 to receive one of the bushings 184 within the cavity 204.

Figure 14:
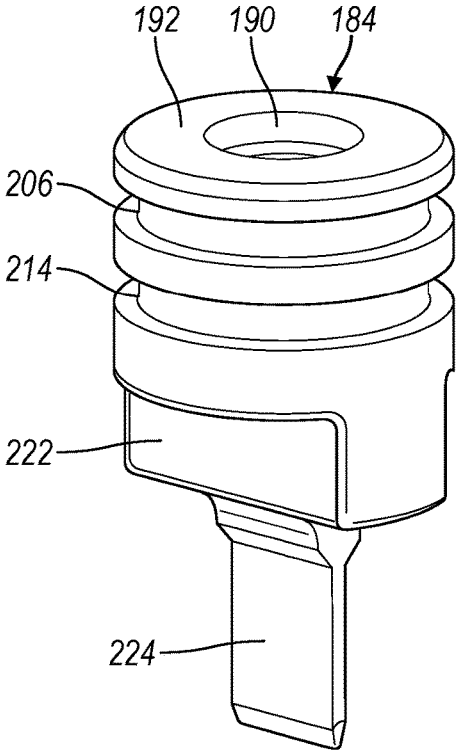
FIG. 14 is a side perspective view of a conductive body of the electrical connector assembly of FIG. 10.
Figure 15:
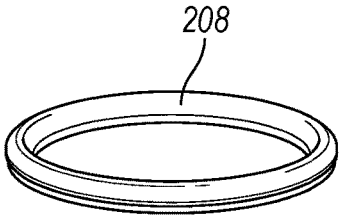
FIG. 15 is a side perspective view of a seal of the electrical connector assembly of FIG. 10.

With reference to FIGS. 11, 12 and 14, an annular groove 206 is formed about each bushing 184. With reference to FIGS. 11 and 12, a gasket or ring seal 208 is provided in the bushing annular groove 206 to engage an inner wall of the cavity 204 to seal the connection of the bushing 184 with the header 194. A plurality of grooves 210 are formed underneath the flange 196. A plurality of gaskets or seal rings 212 are provided in each groove 210 to engage the housing and seal a connection of the header 194 upon the housing.

With reference to FIGS. 11, 12 and 14, each bushing 184 includes an additional annular groove 214 formed circumferentially about the bushing 184. Referring again to FIG. 11, each socket 200 of the header 194 includes a plurality of retainers 216 with a leading edge to expand as the bushing 184 is inserted into the cavity 204, and an abutment edge to retract and enter the groove 214 to engage the groove 214 and retain the bushing 184 axially within the header 194.

With reference to FIG. 11, the cavity 204 extends to a blind depth 218 to limit insertion of the bushing 184 and the stud 172. Referring now to FIGS. 10-12, each socket 200 also includes a smaller limited symmetry socket 220 extending below the blind depth 218 of the cavity 204. Now, with reference to FIGS. 10-12 and 14, each bushing 184 includes a limited symmetry extension 222. The receipt of the bushing extension 222 in the socket 220 limits rotation of the bushings 184 relative to the header 194.

Referring once again to FIGS. 10-12 and 14 an electrical terminal blade 224 is formed integrally to each bushing extension 222 and extends through an aperture 226 (FIGS. 11 and 12) in the header 194. The electrical terminal blades 224 extend through the header 194 into the housing to provide electrical contact with an internal electrical component, such as a PCB. Although the bushings 184 are not radially symmetrical to limit rotation, the bushings have a plane of mirrored symmetry through the terminal blades 224 so that the bushings 184 can be installed in two similar positions. The header 194 includes a pair of alignment pins 228 (FIGS. 10-12) for alignment of the header 194 and the terminal blades 224 with the housing and the associated internal electrical components, such as the PCB.

The electrical connector assembly 170 permits blind insertion of terminal blades 224 into a housing and the enclosed electrical components. The copper-alloy bushings 184 permit efficient current flow, while the studs 172 provide robust fixation of the terminal blades 224. The electrical connector assembly 170 provides seals 208, 212 for a water-tight connection of the electrical connector assembly 170 to the housing. The stud 172, the bushing 184 and the terminal blade 224 provide compactness to the electrical connector assembly 170, which can extend a sufficient length to cooperate with the associated housed electrical components.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electrical connector assembly comprising:

a fastener with an elongate body with a threaded portion to receive an electrical terminal, and to receive a threaded fastener to retain the electrical terminal;

a conductive body cooperating with the elongate fastener body to engage the electrical terminal; and an insulative housing partially enclosing and sealing the fastener or the conductive body; and wherein the insulative housing further comprises a pin to extend through a printed circuit board (PCB) to align the conductive body and the fastener relative to the PCB.

2. The electrical connector assembly of claim 1 wherein the insulative housing is molded over the fastener or the conductive body.

3. The electrical connector assembly of claim 1 further comprising a seal oriented between the conductive body and the insulative housing to seal the conductive body; and wherein a groove is formed about the conductive body and the seal is oriented within the groove to engage the insulative housing.

4. The electrical connector assembly of claim 1 wherein the elongate body of the fastener is provided with a splined portion and the threaded portion includes an externally threaded distal end to receive the electrical terminal and to receive the threaded fastener to retain the electrical terminal, and an annular groove is formed about the elongate fastener body;

wherein the conductive body is formed from a material with greater conductivity than a material of the fastener with a through aperture to receive the externally splined elongate fastener body with an interference fit to limit rotation of the elongate fastener body, and the conductive body having a contact surface to engage the electrical terminal;

wherein the electrical connector assembly further comprises a seal ring oriented within the annular groove in the elongate fastener body to engage the conductive body through aperture and to seal the conductive body through aperture; and an electrical terminal extending through the insulative housing spaced apart from the externally threaded distal end of the fastener in electrical communication with the conductive body.

5. The electrical connector assembly of claim 1 further comprising an electrical terminal oriented partially within the insulative housing in electrical contact with the conductive body and extending through the housing for an external electrical connection.

6. The electrical connector assembly of claim 5 wherein the electrical terminal is welded to the conductive body or wherein the electrical terminal is formed integrally with the conductive body.

7. An electrical connector assembly comprising:

a fastener with an elongate body with a threaded portion to receive a first electrical terminal, and to receive a threaded fastener to retain the first electrical terminal;

a conductive body cooperating with the elongate fastener body to engage the first electrical terminal;

an insulative housing partially enclosing and sealing the fastener or the conductive body; and a second electrical terminal oriented partially within the insulative housing in electrical contact with the conductive body and extending through the housing for an external electrical connection;

wherein the second electrical terminal is welded to the conductive body or wherein the second electrical terminal is formed integrally with the conductive body;

wherein the conductive body has limited symmetry; and wherein a socket is formed in the insulative housing with limited symmetry to receive the conductive body, and to limit rotation of the conductive body relative to the insulative housing.

8. An electrical connector assembly comprising:

a fastener with an elongate body with a threaded portion to receive a first electrical terminal, and to receive a threaded fastener to retain the first electrical terminal;

a conductive body cooperating with the elongate fastener body to engage the first electrical terminal;

an insulative housing partially enclosing and sealing the fastener or the conductive body; and a second electrical terminal oriented partially within the insulative housing in electrical contact with the conductive body and extending through the housing for an external electrical connection;

wherein the second electrical terminal is welded to the conductive body or wherein the second electrical terminal is formed integrally with the conductive body;

wherein the conductive body further comprises at least one asymmetrical extension; and wherein an asymmetrical socket is formed in the insulative housing to receive the conductive body, and to avoid inadvertent assembly of the electrical connector assembly.

9. An electrical connector assembly comprising:

a fastener with an elongate body with a threaded portion to receive a first electrical terminal, and to receive a threaded fastener to retain the first electrical terminal;

a conductive body cooperating with the elongate fastener body to engage the first electrical terminal;

an insulative housing partially enclosing and sealing the fastener or the conductive body; and a second electrical terminal oriented partially within the insulative housing in electrical contact with the conductive body and extending through the housing for an external electrical connection;

wherein the second electrical terminal is welded to the conductive body or wherein the second electrical terminal is formed integrally with the conductive body; and wherein the second electrical terminal further comprises an electrical terminal blade.

10. An electrical connector assembly comprising:

a fastener with an elongate body with a threaded portion to receive an electrical terminal, and to receive a threaded fastener to retain the electrical terminal; and a conductive body cooperating with the elongate fastener body to engage the electrical terminal and to limit rotation of the fastener relative to the conductive body;

wherein the threaded portion of the fastener is externally threaded;

wherein the threaded portion is at one end of the fastener;

wherein the fastener has a second threaded portion at another end of the fastener;

wherein the conductive body extends through a printed circuit board and a filter; and wherein the fastener extends through the conductive body and a busbar.

11. The electrical connector assembly of claim 10 further comprising a seal provided between the fastener and the conductive body.

12. The electrical connector assembly of claim 10 wherein the conductive body is formed from a material with greater conductivity than a material of the fastener.

13. An electrical assembly comprising:

a housing with an opening formed therein;

a busbar oriented within the housing;

a filter oriented about the housing opening;

a printed circuit board (PCB) oriented within the housing;

an electrical connector assembly according to claim 1 mounted to the housing with the conductive body extending through the filter and the PCB and the second threaded end of the fastener extending through the busbar;

an electrical terminal mounted about the first threaded end of the fastener external of the housing and in electrical contact with the conductive body;

a first internally threaded fastener fastened to the first threaded end of the fastener to retain the electrical terminal in electrical communication with the conductive body; and a second internally threaded fastener fastened to the second threaded end of the fastener to retain the busbar in electrical communication with the conductive body.

14. The electrical connector assembly of claim 10 wherein the conductive body has an aperture formed therein, with the elongate fastener body received within the aperture.

15. The electrical connector assembly of claim 14 wherein the elongate fastener body is externally splined and in engagement with the conductive body aperture to limit rotation of the elongate fastener body relative to the conductive body.

16. The electrical connector assembly of claim 14 wherein the elongate fastener body is externally threaded and in threaded engagement with the conductive body aperture to limit movement of the elongate fastener body relative to the conductive body.

17. The electrical connector assembly of claim 14 wherein the conductive body aperture or the elongate fastener body is sized to limit rotation of the fastener relative to the conductive body.

18. The electrical connector assembly of claim 14 wherein a groove is formed about the elongate fastener body; and wherein a seal is oriented within the groove to engage the conductive body aperture and to seal the conductive body aperture.

19. The electrical connector assembly of claim 18 wherein the groove is annular, and the seal is a ring.

* * * * *